248-205.2 SR
10/22/85 OR 4,548,375

United States Patent [19]
Moss

[11] Patent Number: 4,548,375
[45] Date of Patent: Oct. 22, 1985

[54] HOLDER FOR ALL ITEMS AND THE LIKE

[76] Inventor: Ernest Moss, 157-16 13th Ave., Beechhurst, N.Y. 11357

[21] Appl. No.: 485,441

[22] Filed: Apr. 15, 1983

[51] Int. Cl.[4] ..... A47G 29/00
[52] U.S. Cl. ..... 248/205.2; 383/24
[58] Field of Search ..... 248/205.1, 205.3, 205.5, 248/205.7, 102, 205.2; 383/23, 901, 22, 24

[56] References Cited

U.S. PATENT DOCUMENTS

| | | | |
|---|---|---|---|
| Re. 28,289 | 12/1974 | Calkins | 248/205.3 X |
| 546,033 | 9/1895 | Shepard | 248/102 |
| 651,819 | 6/1900 | Bradshaw | 383/901 X |
| 2,755,051 | 7/1956 | Cook | 248/102 |
| 2,903,171 | 9/1959 | Rutledge, Jr. | 211/70.7 |
| 3,016,221 | 1/1962 | Underwood | 248/102 |
| 3,180,384 | 4/1965 | Seifert | 383/23 X |
| 3,321,068 | 5/1967 | Beach | 248/205.2 X |
| 3,638,284 | 2/1972 | Baker | 248/205.2 |

*Primary Examiner*—Robert W. Gibson, Jr.
*Assistant Examiner*—David L. Talbott

[57] ABSTRACT

A holder for all items and the like is provided and consists of a flexible expandable sleeve made of durable material to hold the items within, a first attachment element affixed onto the sleeve and a second attachment element affixed onto a surface whereby the first attachment element is readily releasably from the second attachment element.

7 Claims, 6 Drawing Figures

HOLDER FOR ALL ITEMS AND THE LIKE

BACKGROUND OF THE INVENTION

The instant invention relates generally to holders and more specifically it relates to a holder for all items and the like.

Numerous holders have been provided in prior art that are adapted to hold various items. For example, U.S. Pat. Nos. 3,466,774, 3,814,367, and 3,994,465 all are illustrative of such prior art. While these units may be suitable for the particular purpose to which they address, they would not be as suitable for the purposes of the present invention as heretofore described.

SUMMARY OF THE INVENTION

A principle object of the present invention is to provide a holder for all items and the like that is a flexible expandable sleeve to hold the items within it that can be releasably attached to a vertical flat surface, and mounted to said surface in various directional orientations.

Another object is to provide a holder for all items and the like that has a bottom portion in the sleeve so that the sleeve can hold small items within.

An additional object is to provide a holder for all items and the like that is a flexible expandable sleeve to hold the items within it that can be attached to a belt whereby the sleeve can be strapped to a person.

A further object is to provide a holder for all items and the like that is simple and easy to use.

A still further object is to provide a holder for all items and the like that is economical to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
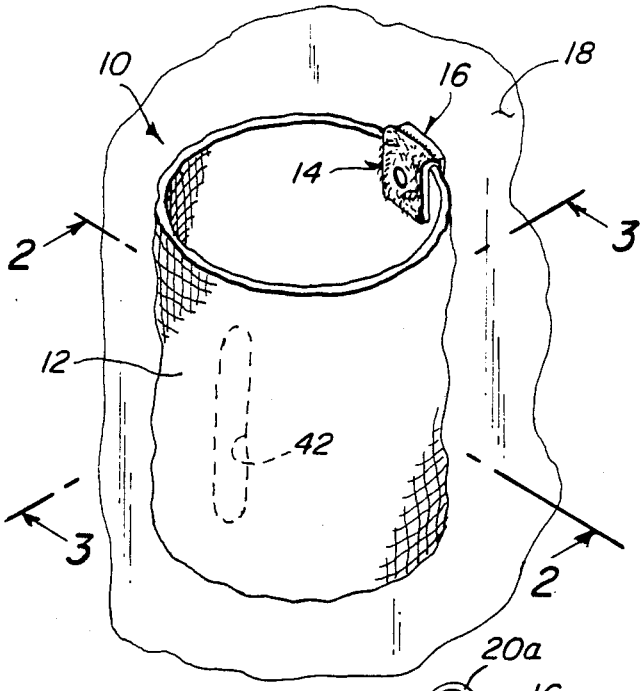
FIG. 1 is a perspective view of the invention.
Figure 2:
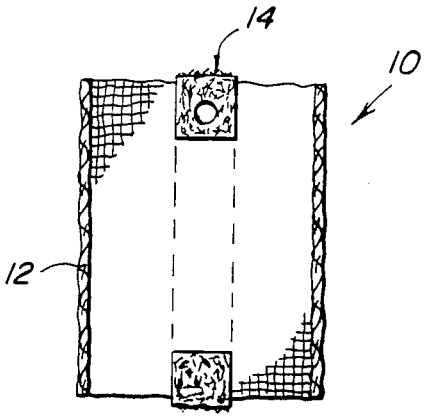
FIG. 2 is a cross sectional view taken on line 2—2 of FIG. 1.

Turning now descriptively to the drawings, in which similar reference characters denote similar elements throughout the several views, FIGS. 1 through 5 illustrates a holder 10 for all items and the like. The holder

10 consists of a flexible expendable sleeve 12 made of durable material, such as knitted fabric, a first attachment element 14 affixed onto the sleeve 12 and a second attachment element 16 which may be affixed onto a flat surface 18, such as a wall. The first attachment element 14 being readily engaging with and readily releasable from the second attachment element 16. The sleeve 12 is releasably attached to the vertical flat surface 18 so that the items 11 within the sleeve 12 are readily available.

Figure 3:
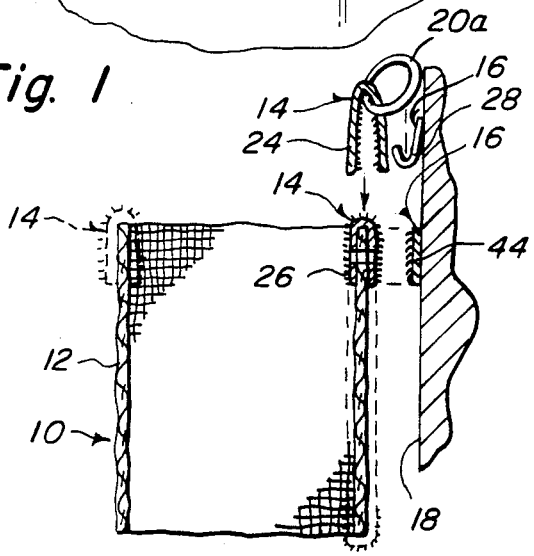
FIG. 3 is a cross sectional view taken on line 3—3 of FIG. 1.
Figure 4:
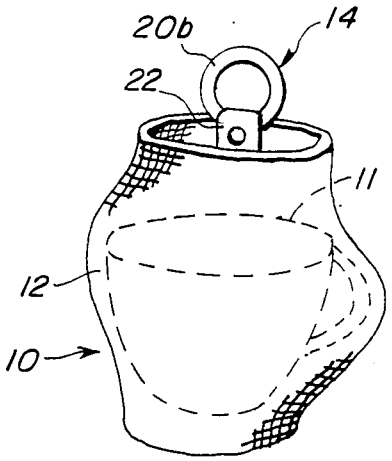
FIG. 4 is a perspective of the invention illustrated holding a cup as a typical item.

The first attachment element 14 can be a ring 20*a* and 20*b* as shown in FIGS. 3 and 4. The ring 20*b* in FIG. 4 is directly attached to the sleeve 12 at loop member 22. In FIG. 3 the ring 20*a* can be removably attached to the sleeve 12 by utilizing a loop pile fastener member 24 attached to mating loop pile fastener member 26. The second attachment element can be a hook 28, or alternately mating loop pile fastener element 44, may be attached directly to loop pile fastener member 26.

In FIG. 3 it is also illustrated that the size of the loop pile element is such that it may be confined to just a small area or it may be extensive and over a large surface of the device and even be distributed in several separate and discrete locations.

Figure 5:
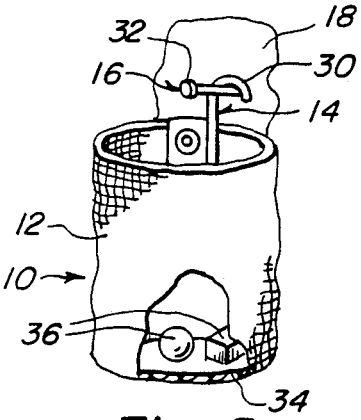
FIG. 5 is a perspective view of a second embodiment of the invention with parts broken away showing a modification which is closed one one end in order to hold small parts etc.

In FIG. 5 the first attachment 14 is a hook 30 and the second attachment element 16 is a fastener 32 such as a nail or a screw. As a modified form of the invention, the sleeve 12 further contains a bottom portion 34 so that the sleeve 12 can hold small items 36 within.

Figure 6:
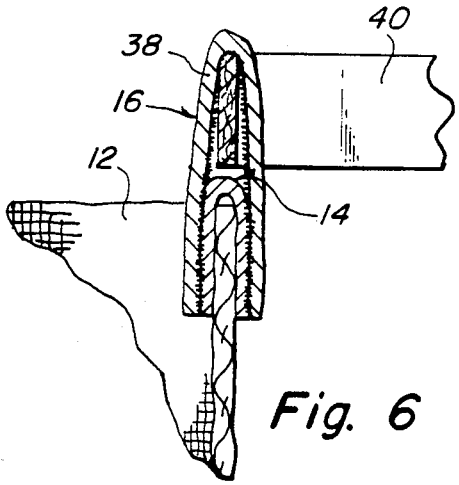
FIG. 6 is an enlarged fragmentary cross sectional view of the invention showing still another modification.

In FIG. 6 the first attachment element 14 is affixed onto the sleeve 12 while the second attachment element 16 is removably affixed onto the first attachment element 14 as a loop 38 so that a belt 40 can go therethrough. The sleeve 12 can then be strapped to a person (not shown).

As shown in FIGS. 1, 2, 3 and 6 one of the attachment elements 14 or 16 is mating loop pile fastener elements which secure to each other in a well known manner.

A typical item 11 such as a cup in FIG. 4 may be placed into the sleeve 12. The sleeve 12 can then be releasably attached to the vertical flat surface 18 via first and second attachment elements 14 and 16 so that the item 11 within the sleeve 12 is readily available.

As an optional feature at least one or more openings 42, shown in dotted lines in FIG. 1, can be at various locations in side wall of sleeve 12. The openings 42 may be of various sizes and shapes to accommodate different items 11.

In operative use the sleeve may naturally be manufactured in any proportions from those resembling a long tube or just a narrow band as special requirements may dictate, and out of any suitable material which is stretchable and flexible.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A holder for all items and the like which comprises:

a flexible expandable sleeve open at least one end, made of durable material to hold the items within it; at least one elongated strip of one part of loop pile fastener secured along the entire length of the exterior of the sleeve, a portion of said strip bending over the edge of said sleeve and extending part way along the interior surface of said sleeve, a tab of the mating part of the loop pile fastener for securing said sleeve in various directional orientation, onto a support surface; an inverted "U" shaped strip of the mating part of the loop pile fastener having a pair of leg portions for matingly coupling onto said elongated strip of said one part loop pile fstener so as to straddle the bent over portion of said elongated strip and project upwardly therefrom to form a loop, and a securing member for passing through said loop, whereby said sleeve can be supported at any desired height by said mating loop pile coupling and can depend from a support by said loop pile and securing member.

2. A holder as in claim 1 wherein said securing means comprises at least one strip of one part of loop pile fastener secured along the partial length of the exterior, a portion of said strip bending over the edge.

3. A holder as in claim 1 wherein said securing means comprises at least one strip of one part of loop pile fastener secured along the exterior of the sleeve.

4. A holder as in claim 1 wherein said securing means comprises a ring loop for securing onto a hook or protrusion.

5. A holder as in claim 1 wherein said securing means comprises a hook for securing onto an opening or protrusion.

6. A holder as in claim 1 wherein said securing means comprises a belt whereby said sleeve can be strapped to a person.

7. A holder for all items and the like as recited in claim 1, 2, 3, 4, 5, or 6 wherein said holder has one open end and one closed end.

* * * * *